US008373734B2

(12) United States Patent
Kim

(10) Patent No.: US 8,373,734 B2
(45) Date of Patent: Feb. 12, 2013

(54) IMAGE FORMING APPARATUS AND CONTROL METHOD THEREOF

(75) Inventor: Jong-tae Kim, Gwacheon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/615,398

(22) Filed: Nov. 10, 2009

(65) Prior Publication Data

US 2010/0119246 A1 May 13, 2010

(30) Foreign Application Priority Data

Nov. 12, 2008 (KR) ..... 10-2008-0112427

(51) Int. Cl.
*B41J 2/435* (2006.01)
*B41J 2/47* (2006.01)

(52) U.S. Cl. ..... 347/235; 347/250

(58) Field of Classification Search ..... 347/229, 347/234–237, 246–250
See application file for complete search history.

(56) References Cited

U.S. PATENT DOCUMENTS

| | | | | |
|---|---|---|---|---|
| 5,448,266 | A * | 9/1995 | Jamzadeh | 347/225 |
| 5,627,670 | A * | 5/1997 | Minoura et al. | 359/196.1 |
| 6,785,011 | B1 * | 8/2004 | Cook | 358/1.1 |
| 2008/0068678 | A1 * | 3/2008 | Suzuki et al. | 358/481 |

FOREIGN PATENT DOCUMENTS

JP 2001154130 A * 6/2001

* cited by examiner

*Primary Examiner* — Hai C Pham
(74) *Attorney, Agent, or Firm* — Stanzione & Kim, LLP

(57) ABSTRACT

An image forming apparatus, and a method of controlling same, the image forming apparatus including an image carrying body; a light exposing unit which emits a light toward the image carrying body according to a light exposing signal; a light sensor which is disposed to a side of the image carrying body to receive a part of the emitted light; and a control unit which detects a biased amount in a sub scanning direction of the emitted light of the light exposing unit based on a sensing result of the light sensor.

19 Claims, 12 Drawing Sheets

IMAGE FORMING APPARATUS AND CONTROL METHOD THEREOF

CROSS-REFERENCE TO RELATED APPLICATIONS

This application claims the benefit under 35 U.S.C. §119 (a) of Korean Patent Application No. 10-2008-0112427, filed on Nov. 12, 2008, in the Korean Intellectual Property Office, the disclosure of which is incorporated herein by reference in its entirety.

BACKGROUND

1. Field of the Invention

An apparatus and a method consistent with the present general inventive concept relate to an image forming apparatus and a control method thereof, and more particularly, to an image forming apparatus and a control method thereof having a light exposing unit to precisely expose an image carrying body.

2. Description of the Related Art

An electrophotographic image forming apparatus prints an image on a printing medium through a series of processes of charging, exposing, developing, transferring, fusing and cleaning. Examples of an electrophotographic image forming apparatus include a laser printer, an electronic copier, a multifunction device, etc.

The electrophotographic image forming apparatus includes a photosensitive body, and a light exposing unit exposing light upon a surface of the photosensitive body in a main scanning direction to correspond to an image to be printed. If the surface of the photosensitive body is exposed to the light from the light exposing unit, an electrostatic latent image is formed on the surface by an electric potential difference, and the electrostatic latent image is developed by a developer so that a visible image embodied by the developer can be formed on the surface of the photosensitive body.

The visible image is transferred to a printing medium, and the transferred visible image is fused to the printing medium by a fusing unit.

However, a unit body of the light exposing unit and a light exposing unit supporting configuration such as a support frame supporting the light exposing unit, etc., may be deformed by heat generated by the fusing unit.

FIG. 1 is a graph illustrating a position error between an actual exposure position and an intended exposure position and a color registration error V according to an inner temperature of the light exposing unit when light exposing signals corresponding to colors of yellow Y, cyan C, black K and magenta M are exposed upon the corresponding photosensitive bodies. As illustrated in the graph, the color registration error V increases as the temperature increases from the temperature of approximately 35 degrees Celcius, and rapidly increases as the temperature increases to more than 50 degrees Celcius. The illustrated positional errors occur because the light exposing unit designed to expose a uniform light exposure upon a certain position of the surface of the photosensitive body begins to expose light upon other positions different from the intended light exposure position as the temperature increases and the supporting configuration is deformed by the heat.

If the light exposing unit is deformed by heat with respect to the main scanning direction, the light exposure position may be biased in a sub scanning direction (a proceeding direction of the printing medium) which is vertical to the main scanning direction. The bias of the light exposure position in the sub scanning direction has a direction effect on the color registration error.

In the conventional image forming apparatus, to prevent the deformation by heat of the light exposing unit, a separate cooling mode is provided. More particularly, if the temperature of the light exposing unit becomes more than a predetermined value, a printing work is suspended temporarily or the printing speed is reduced according to the cooling mode. However, as the cooling mode is performed, the printing speed decreases.

SUMMARY

Accordingly, a feature of the present general inventive concept is to provide an image forming apparatus in which a light exposing precision of a light exposing unit is improved.

Another feature of the present general inventive concept is to provide an image forming apparatus uniformly maintaining a light exposure position on a surface of an image carrying body although a supporting configuration of a light exposing unit is deformed by heat.

Still another feature of the present general inventive concept is to provide an image forming apparatus in which a printing speed is improved.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an image forming apparatus, including at least one image carrying body; a light exposing unit which emits a light toward the image carrying body according to a light exposing signal; a light sensor which is disposed to a side of the image carrying body to receive a part of the emitted light; and a control unit which detects a biased amount in a sub scanning direction of the emitted light of the light exposing unit based on a sensing result of the light sensor.

The control unit may correct the light exposing signal based on the detected biased amount and control the light exposing unit to emit a light toward the image carrying body according to the corrected light exposing signal.

The light sensor may include a plurality of light receiving elements biased in the sub scanning direction.

The plurality of light receiving elements may be biased in order by a predetermined interval in the sub scanning direction.

The apparatus may further include a mask which is formed with a plurality of slits.

The light sensor may include a plurality of light receiving sensors which respectively receive a light passing through the plurality of slits.

The plurality of slits may be disposed in a line or in a plurality of lines in the sub scanning direction.

The plurality of slits may be provided to have a uniform interval between central parts of vicinal slits.

The uniform interval may correspond to an interval between dots in a predetermined resolution.

The image carrying body may include a plurality of image carrying bodies.

The light sensor may be disposed to a side of at least one of the plurality of image carrying bodies.

The foregoing and/or other features and utilities of the present general inventive concept may also be achieved by providing a method of controlling an image forming apparatus having an image carrying body, the method including emitting a light toward the image carrying body according to a light exposing signal; receiving the emitted light at a light sensor disposed to a side of the image carrying body; and detecting a biased amount in a sub scanning direction of the emitted light based on a light receiving result of the light sensor.

The method may further include correcting a subsequent light exposing signal based on the detected biased amount, and emitting a light toward the image carrying body depending on the corrected light exposing signal.

The correcting the subsequent light exposing signal may include correcting the subsequent light exposing signal based on the detected biased amount in response to the subsequent light exposing signal being a page starting light exposing signal to be formed first on a page of a printing medium.

The correcting the subsequent light exposing signal may include delaying the correcting of the subsequent light exposing signal until the subsequent light exposing signal is a page starting light exposing signal, and then correcting the subsequent light exposing signal and following light exposing signals based on the detected biased amount.

The foregoing and/or other features and utilities of the present general inventive concept may also be achieved by providing a recording medium having recorded thereon a program to control a computer to perform a method of controlling an image forming apparatus having an image carrying body, the method including emitting a light toward the image carrying body according to a light exposing signal; receiving the emitted light at a light sensor disposed to a side of the image carrying body; and detecting a biased amount in a sub scanning direction of the emitted light based on a light receiving result of the light sensor.

The foregoing and/or other features and utilities of the present general inventive concept may also be achieved by providing a method of controlling an image forming apparatus, the method including receiving light emitted toward an image carrying body at a light sensor adjacent to the image carrying body; and detecting a bias in a sub scanning direction of the emitted light according to the light sensor.

The method may further include determining an amount of the bias according to the light sensor.

The method may further include correcting a light exposing signal which controls the emitted light according to the amount of the bias.

The method may further include determining a direction of the bias according to the light sensor.

The correcting the light exposing signal may include changing the timing of the light exposing signal.

The changing of the timing of the light exposing signal may be determined by an equation in which the changing of the timing of the light exposing signal is equal to the amount of the bias of the emitted light divided by the rotation speed of the image carrying body.

The correcting of the light exposing signal may be delayed until the light exposing signal is a page starting light exposing signal which begins a new page of printing.

The correcting of the light exposing signal may include shifting a timing of the light exposing signal such that the emitted light is emitted earlier to correct the bias.

The correcting of the light exposing signal may include shifting a timing of the light exposing signal such that the emitted light is emitted later to correct the bias.

The foregoing and/or other features and utilities of the present general inventive concept may also be achieved by providing an image forming apparatus including an image carrying body to receive emitted light; and a light sensor provided adjacent to the image carrying body to receive part of the emitted light and to detect a bias in a sub scanning direction of the emitted light.

The image forming apparatus may further include a controller to determine an amount of the bias according to results of the light sensor.

The controller may correct a light exposing signal which controls the emitted light to eliminate the bias.

The light sensor may include a plurality of light receiving elements provided in the scanning direction, and biased in the sub scanning direction.

The light receiving elements may be provided at offset intervals such that the amount of bias may be determined by the one or more light receiving elements receiving the emitted light.

The light sensor may include a plurality of light receiving elements provided in a scanning direction; and a mask with a plurality of slits which correspond to the respective light receiving elements, and which are biased in the sub scanning direction.

The slits may be provided with predetermined dimensions and at offset intervals such that the amount of bias may be determined by the one or more light receiving elements receiving the emitted light through the slits.

The light sensor may include a plurality of light receiving elements provided in a sub scanning direction; and a mask with a plurality of slits which correspond to the respective light receiving elements, and which are provided in the sub scanning direction.

The slits may be provided with predetermined dimensions and at offset intervals such that the amount of bias may be determined by the one or more light receiving elements receiving the emitted light through the slits.

BRIEF DESCRIPTION OF THE DRAWINGS

These and/or other features and advantages of the present general inventive concept will become apparent and more readily appreciated from the following description of various exemplary embodiments, taken in conjunction with the accompanying drawings of which.

DETAILED DESCRIPTION OF THE EMBODIMENTS

Figure 1:
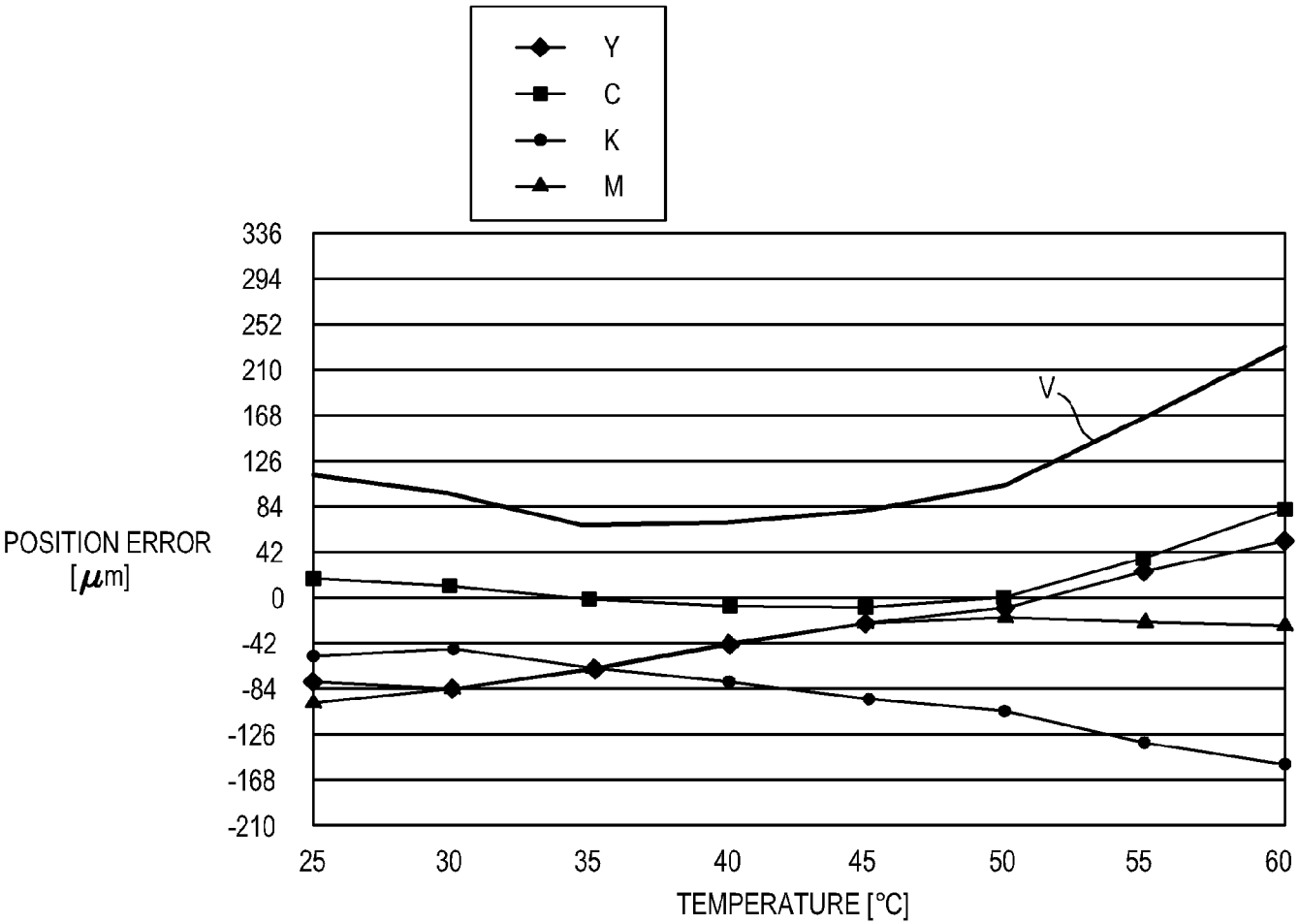
FIG. 1 is a graph illustrating a light exposure position error and a color registration error according to an inner temperature of a light exposing unit of a conventional image forming apparatus.

Reference will now be made in detail to various exemplary embodiments of the present general inventive concept, examples of which are illustrated in the accompanying drawings, wherein like reference numerals refer to like elements throughout. The exemplary embodiments are described below in order to explain the present general inventive concept by referring to the figures. Repetitive description with respect to like elements of different embodiments may be omitted for the convenience of clarity.

Figure 2:
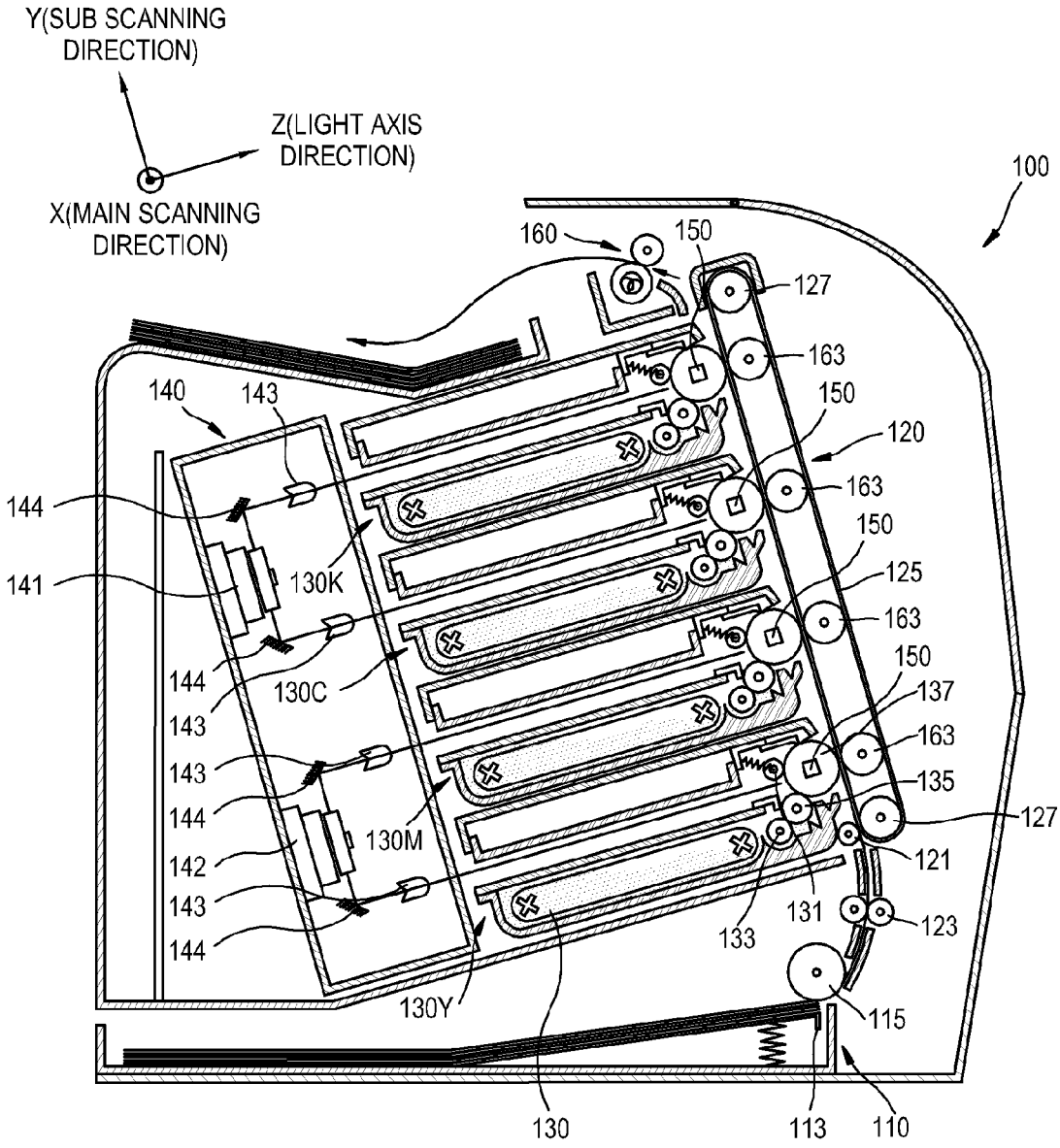
FIG. 2 illustrates a schematic sectional view of an image forming apparatus according to an exemplary embodiment of the present general inventive concept.
Figure 3:
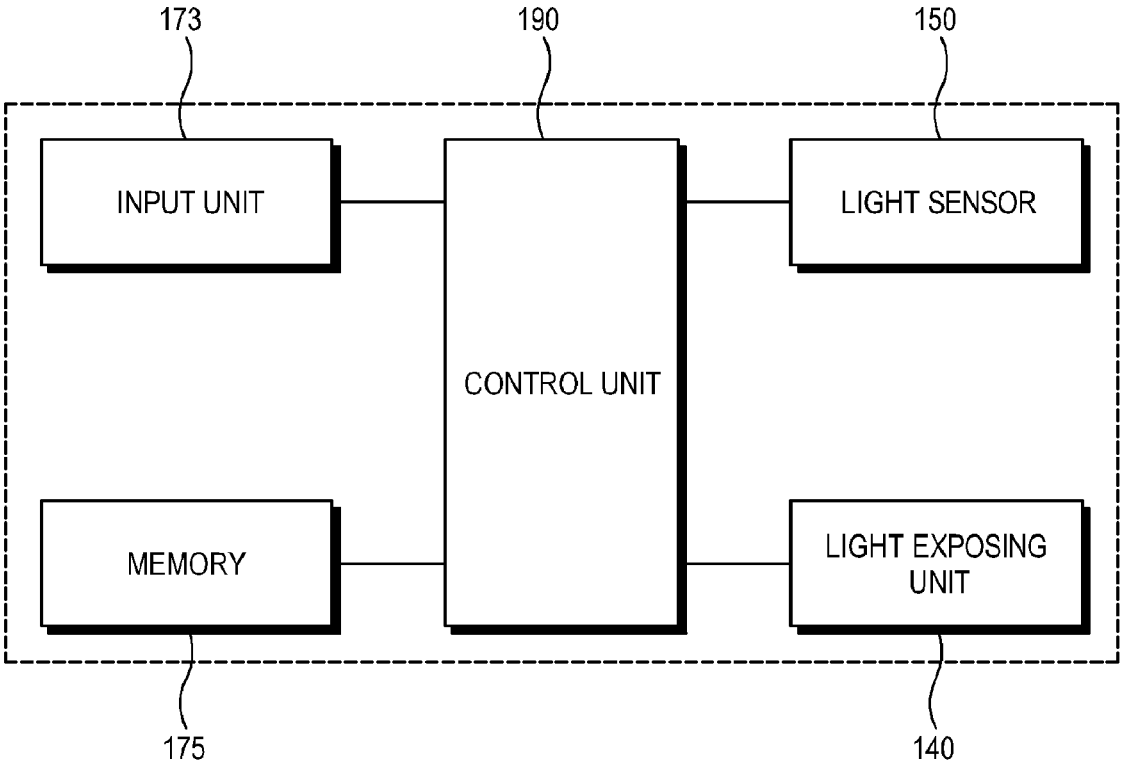
FIG. 3 is a schematic block diagram illustrating the image forming apparatus in FIG. 2.

FIG. 2 illustrates a schematic sectional view of an image forming apparatus according to an exemplary embodiment of the present general inventive concept, and FIG. 3 is a schematic block diagram illustrating the image forming apparatus in FIG. 2.

As illustrated in FIGS. 2 and 3, an image forming apparatus 100 according to an exemplary embodiment of the present general inventive concept may include a plurality of image carrying bodies 137, a light exposing unit 140 to emit a light toward the image carrying bodies 137 according to light exposing signals, a plurality of light sensors 150 respectively disposed to a side of the image carrying bodies 137 to receive a part of the emitted light, and a control unit 190 to detect a biased amount of the emitted light in a sub scanning direction Y of the light exposing unit 140 based on a sensing result of the light sensors 150.

As illustrated in FIG. 2, a plurality of the image carrying bodies 137 may be provided in the image forming apparatus 100. However, it is possible that the image forming apparatus 100 could have only one image carrying body 137, as well as any number other than that illustrated in FIG. 2. Also, the image carrying bodies 137 may be respectively accommodated to developing cartridges 130 storing a developer of a predetermined color.

For example, the developing cartridges 130 may include a yellow cartridge 130Y, a magenta cartridge 130M, a cyan cartridge 130C and a black cartridge 130K respectively storing developers of yellow Y, magenta M, cyan C and black K. Here, the number and color of the developing cartridges 130 are illustrated merely as an example, and it is understood that a single developing cartridge 130, or any other number of developing cartridges 130 other than that illustrated in FIG. 2, may be included in the image forming apparatus 100.

The light exposing unit 140 may emit light toward the image carrying bodies 137 to form an electrostatic latent image on a surface of the respective image carrying bodies 137.

The light exposing unit 140 may include a plurality of light sources (not shown) emitting a light, a plurality of deflectors 141 and 142 deflecting the light emitted by the light sources, a plurality of reflecting mirrors 144 reflecting the light deflected by the deflectors 141 and 142, and a plurality of f-θ lenses 143 imaging the light reflected by the reflecting mirrors 144 onto a surface of the corresponding image carrying bodies 137.

The plurality of light sources may include four light sources to match the number of image carrying bodies 137 so as to respectively expose the emitted light upon the image carrying bodies 137. That is, the plurality of light sources may include a yellow light source (not shown), a magenta light source (not shown), a cyan light source (not shown) and a black light source (not shown) to emit those respective light colors upon the image carrying bodies 137 respectively accommodated to the yellow cartridge 130Y, the magenta cartridge 130M, the cyan cartridge 130C and the black cartridge 130K.

One of the deflectors 141 may deflect light emitted from the cyan light source and the black light source in a main scanning direction X, and one of the deflectors 142 may deflect light emitted from the yellow light source and the magenta light source in the main scanning direction X.

The light exposing unit 140 illustrated in FIG. 2, including the type of a light scanning unit (or laser scanning unit) (LSU) deflecting a light emitted from the light source in the main scanning direction X, is included merely as one possible example of such a light exposing unit 140. Other configurations may be provided for the light exposing unit 140, such as, for example, a light array head (not shown) including a plurality of light sources disposed in the main scanning direction X.

Figure 4:
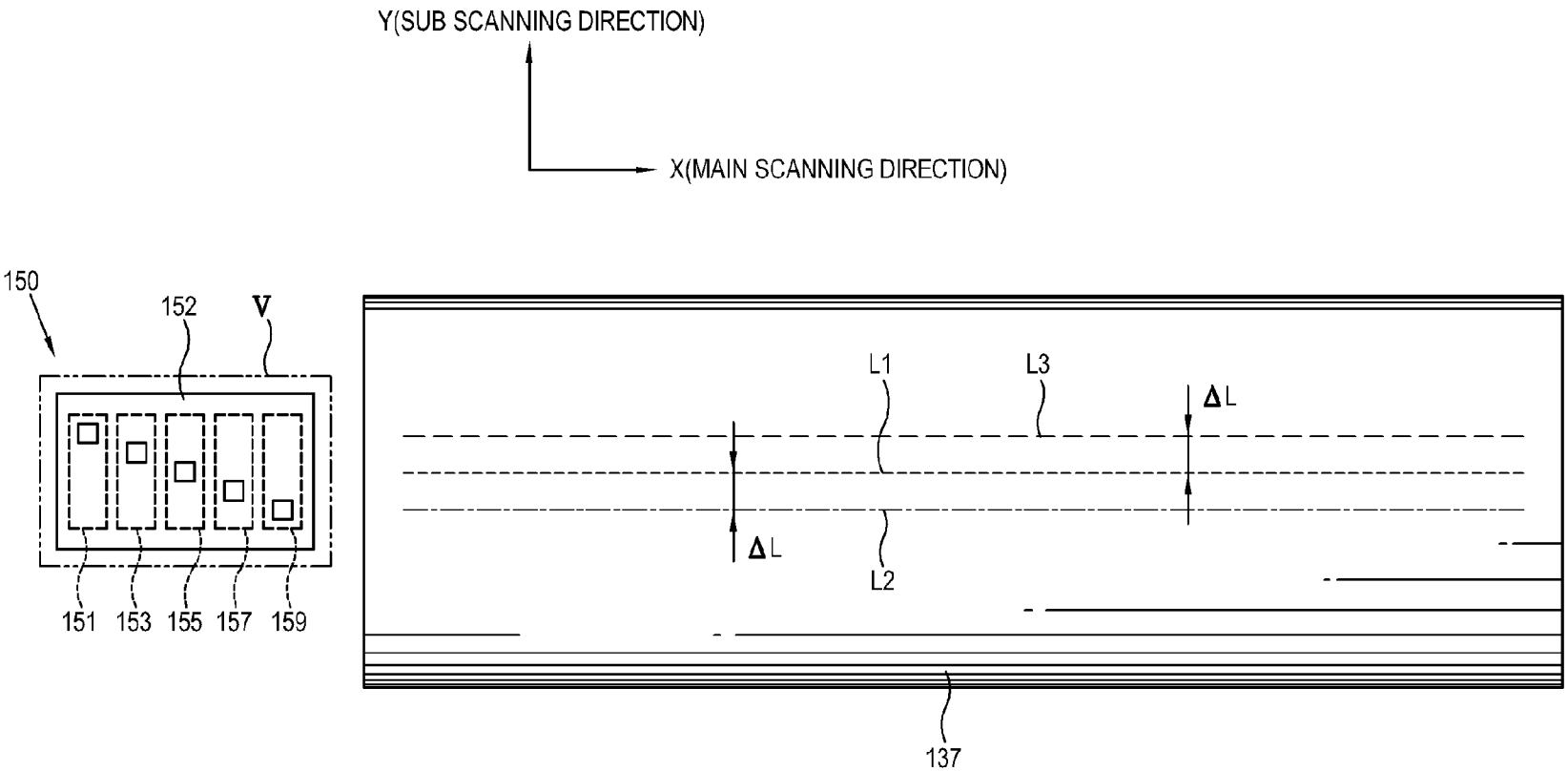
FIG. 4 illustrates an enlarged view of a portion of the image forming apparatus illustrated in FIG. 2.
Figure 5:
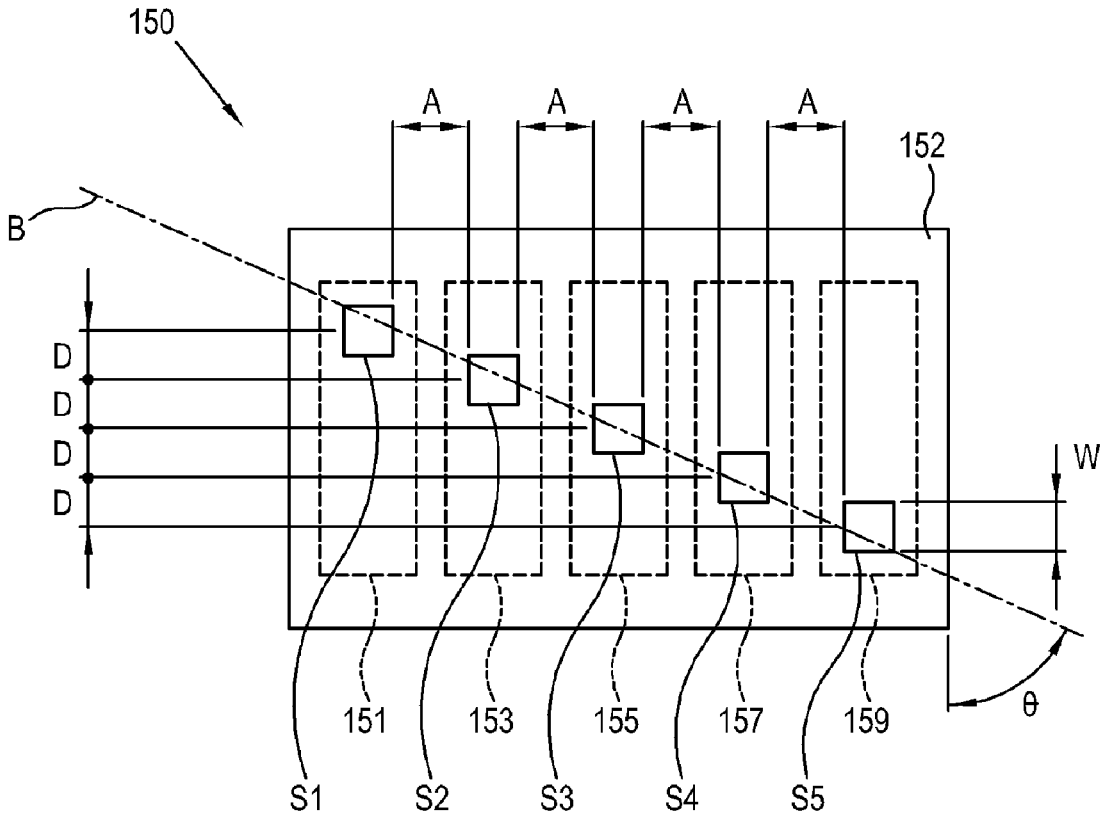
FIG. 5 illustrates an enlarged view of a light sensor V illustrated in FIG. 4.

FIG. 4 illustrates an enlarged view of a portion of the image forming apparatus illustrated in FIG. 2, and FIG. 5 illustrates an enlarged view of a light sensor V illustrated in FIG. 4.

As illustrated in FIGS. 4 and 5, each of the light sensors 150 may include a plurality of light receiving sensors 151, 153, 155, 157 and 159 to receive a light emitted by the light exposing unit 140.

The light sensors 150 are exemplarily described to be disposed to each of the plurality of image carrying bodies 137, but may be disposed to fewer than the entire number of image carrying bodies 137. For example, if a bias in the sub scanning direction happens most heavily among a particular one of the plurality of image carrying bodies 137, the light sensor 150 may be disposed to only that particular one of the image carrying bodies 137. For example, only one light sensor 150 may disposed to only the image carrying body 137 accommodated to the black developer cartridge 130K.

The plurality of light receiving sensors 151, 153, 155, 157 and 159 may be photo sensors detecting the mere existence of a light, but the light receiving sensors 151, 153, 155, 157 and 159 are not limited to any one such configuration. For example, the plurality of light receiving sensors 151, 153, 155, 157 and 159 may include an image sensor.

Also, the image forming apparatus 100 may further include a mask 152 interposed between the plurality of light receiving sensors 151, 153, 155, 157 and 159 and the light exposing unit 140.

The mask 152 may include a plurality of slits S1, S2, S3, S4 and S5 formed to detect a biased amount ΔL in the sub scanning direction Y of a light emitted by the light exposing unit 140.

As illustrated in FIGS. 4 and 5, the plurality of slits S1, S2, S3, S4 and S5 may be provided so as to all have the same size. Also, the plurality of slits S1, S2, S3, S4 and S5 may be provided so that central distances, or intervals D, in the sub scanning direction therebetween are uniform.

As illustrated in FIGS. 4 and 5, the plurality of slits S1, S2, S3, S4 and S5 may be provided to the mask 152 so that a line B passing through the slits S1, S2, S3, S4 and S5 can have a predetermined angle θ with respect to the sub scanning direction Y. The line B may be configured so as to pass through approximate center points of the slits S1, S2, S3, S4 and S5.

As illustrated in FIGS. 4 and 5, the plurality of slits S1, S2, S3, S4 and S5 may be provided to the mask 152 so as to have a uniform interval A in the main scanning direction X.

Alternatively, the interval A in the main scanning direction X may not be uniform. For example, an interval A between the slits S4 and S5 vicinal to the image carrying body 137 may be smaller than an interval A between the slits S1 and S2 distanced therefrom.

Here, each width W in the sub scanning direction Y of the plurality of slits S1, S2, S3, S4, and S5 may be the same as the intervals D in the sub scanning direction Y.

Here, the intervals D in the sub scanning direction may be 42 μm corresponding to an interval between dots (hereinafter, referred to 'dot pitch') in the resolution of 600 dpi. The intervals D may alternatively correspond to the dot pitch in other resolutions (200 dpi, 300 dpi, 1200 dpi, etc.).

As yet another alternative, the intervals D in the sub scanning direction may be a distance corresponding to three times the dot pitch. That is, the intervals D may be 126 μm, corresponding to three time of 42 μm with respect to the resolution of 600 dpi. In general, since a user is capable of recognizing a color registration error in a color image with the naked eye in a case of approximately three times the dot pitch, the intervals D in the sub scanning direction may correspond thereto.

These described intervals D in the sub scanning direction of the plurality of slits S1, S2, S3, S4 and S5 are merely offered as examples, and various changes may be applied as desired.

The plurality of light receiving sensors 151, 153, 155, 157 and 159 may respectively receive the light emitted from the light exposing unit 140 which passes through any of the plurality of slits S1, S2, S3, S4 and S5.

The control unit 190 may detect the biased amount ΔL in the sub scanning direction Y of the light exposing unit 140 depending on a sensing signal received from one or more of the plurality of light receiving sensors 151, 153, 155, 157 and 159.

A method of detecting the biased amount ΔL will be described by referring to FIGS. 4 and 5. In FIG. 4, L1, L2 and L3 are light exposing lines formed on a surface of the image carrying body 137 by the light emitted by the light exposing unit 140.

In this description, the light exposing line L1 is assumed to be the intended light exposing line, or the line at which the light would normally or properly be exposed on the surface of the image carrying body 137 absent any deterioration of the light exposing unit 140.

Information regarding which of the light receiving sensors 151, 153, 155, 157 and 159 normally receives a light emitted by the light exposing unit 140 is stored in a memory 175 of the image forming apparatus 100. Ideally, though not necessarily, the mask 152 will be provided such that the middle light receiving sensor 155 normally receives the light emitted by the light exposing unit 140.

Then, if the light receiving signal of the plurality of light receiving sensors 151, 153, 155, 157 and 159 indicates a change, the biased amount ΔL in the sub scanning direction Y of the light exposing unit 140 is detected based on the corresponding intervals D in the sub scanning direction Y of the plurality of light receiving sensors 151, 153, 155, 157 and 159 according to which of the plurality of light receiving sensors 151, 153, 155, 157 and 159 is then receiving the light emitted by the light exposing unit 140.

For example, it is assumed that a first emitted light emitted by the light exposing unit 140 is received only by the light receiving sensors 155 and 157, and no light is received by the remaining light receiving sensors 151, 153 and 159. That is, the first emitted light may expose the surface of the image carrying body 137 in a direction L1 passing through the slits S3 and S4 of the light receiving sensors 155 and 157. In this example, the first light exposing line formed by the first emitted light is assumed to be L1 illustrated in FIG. 4.

Then, if a second emitted light emitted from the light exposing unit 140 is sensed by the light receiving sensors 151, 153 or 159, which have different positions from the light receiving sensors 155 and 157 that sensed the first emitted light, the light of the light exposing unit 140 is determined to be biased in a forward or backward direction in the sub scanning direction Y.

For example, if a second light exposing line formed on the image carrying body 137 by the second emitted light is assumed to be L2, the light may be received only by the light receiving sensors 157 and 159 of the plurality of light receiving sensors 151, 153, 155, 157 and 159. Since this means that the second emitted light passes through the slits S4 and S5, as illustrated in FIG. 4, it can be determined to be biased in the backward direction of the sub scanning direction Y.

In this example, the biased amount ΔL between the first light exposing line L1 and the second light exposing line L2 is the same as the intervals D in the sub scanning direction, or the central distances between the plurality of slits S1, S2, S3, S4 and S5.

The biased amount ΔL may be defined to be positive if biased in the sub scanning direction Y, and to be negative if biased in the backward direction of the sub scanning direction Y. In this case, the biased amount ΔL between the first light exposing line L1 and the second light exposing line L2 is approximately −D (minus or negative D).

If a third light exposing line L3 is formed on the image carrying body 137 by a third emitted light emitted from the light exposing unit 140, the light may only be received by the light receiving sensors 153 and 155. This means that the third emitted light passes through only the slits S2 and S3. Accordingly, as illustrated in FIG. 4, the third emitted light can be determined to be biased in the forward direction of the sub scanning direction Y.

The biased amount ΔL between the first light exposing line L1 and the third light exposing line L3 is approximately +D (plus or positive D).

As illustrated in FIG. 4, the plurality of slits S1, S2 and S5 may be respectively provided in the forward and backward directions of the sub scanning direction Y about the slits S3 and S4 corresponding to the intended light exposing line L1. Alternatively, if biased in a specific direction by an experience or an experiment, a slit may be provided in only a specific direction about the slits S3 and S4 corresponding to the purpose light exposing line L1.

The control unit 190 may correct the light exposing signal of the light exposing unit 140 based on the detected biased amount ΔL, and may control the light exposing unit 140 to emit a light depending on the corrected light exposing signal.

In more detail, if the detected biased amount ΔL is a positive value in regard to the convention illustrated in FIG. 4, this means that the light emitted by the light exposing unit 140 appears on the image carrying body 137 in the direction of the third light exposing line L3. In other words, the detected biased amount ΔL is biased in the forward direction of the sub scanning direction Y with respect to the intended first light exposing line L1. Accordingly, to correct the positive biased amount ΔL, a light exposing timing of the light exposing unit 140 is shifted to correspond thereto.

Figure 6A:
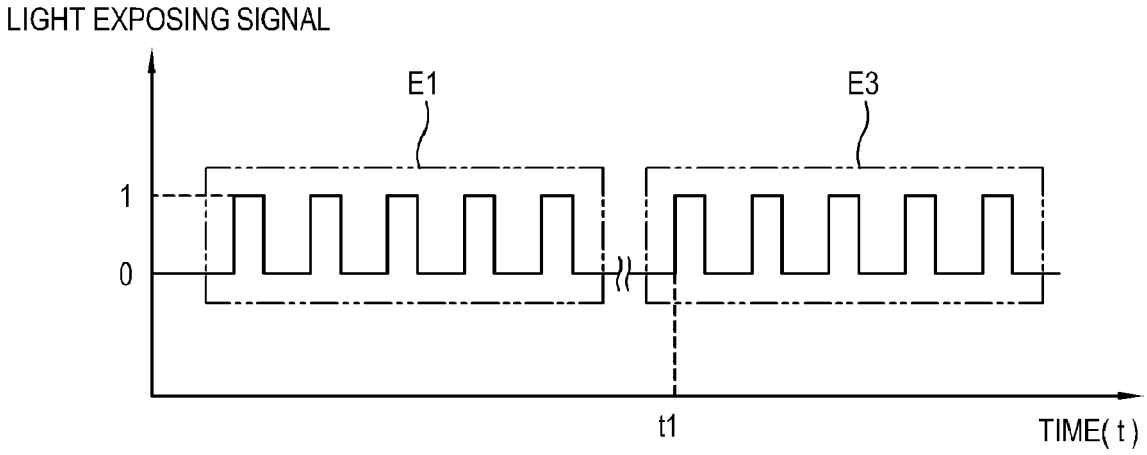
FIG. 6A illustrates a timing diagram of a light exposing signal before correction by a control unit of the image forming apparatus in FIG. 3.
Figure 6B:
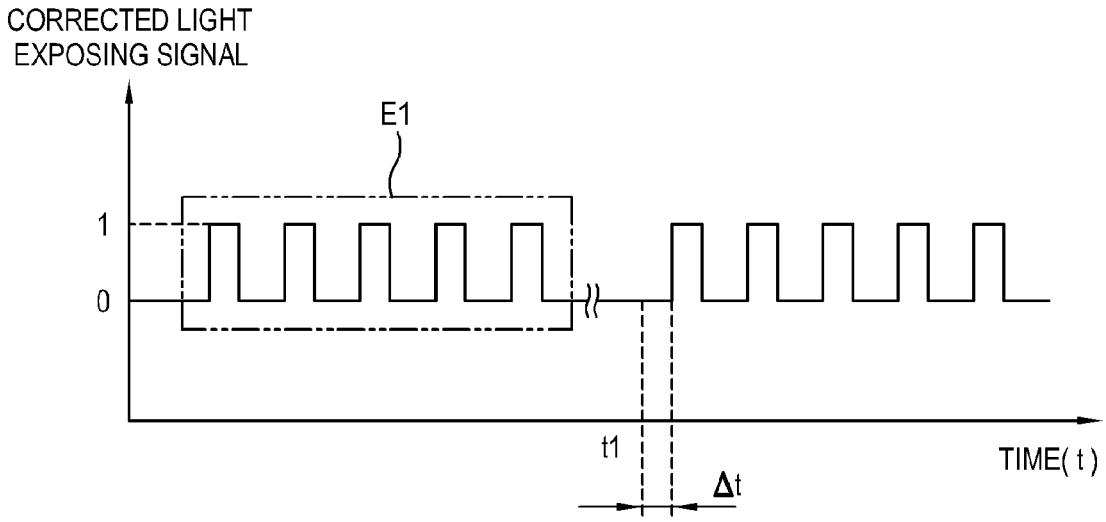
FIG. 6B illustrates a timing diagram of a light exposing signal after correction by the control unit of the image forming apparatus in FIG. 3.

FIG. 6A illustrates a timing diagram of a light exposing signal before correction by a control unit of the image forming apparatus in FIG. 3, and FIG. 6B illustrates a timing diagram of a light exposing signal after correction by the control unit of the image forming apparatus in FIG. 3.

As illustrated in FIGS. 6A and 6B, a light exposing timing t1 of a light exposing signal E3 corresponding to the third light exposing line L3 may be shifted right by a correction time Δt to offset the positive biased amount ΔL.

Here, the correction time Δt may be calculated by the following equation.

$$\Delta t = \frac{\Delta L}{\text{rotation speed of image carrying body 137}} \qquad \text{Equation 1}$$

Figure 7:
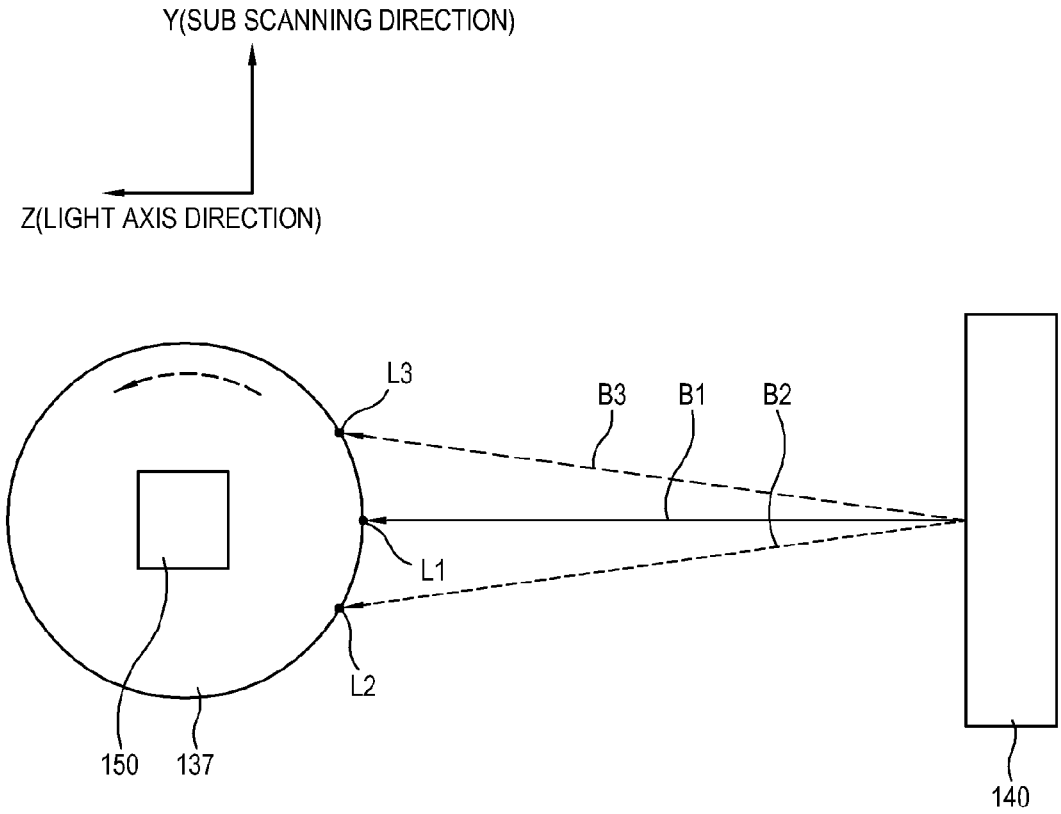
FIG. 7 illustrates an enlarged side view of a portion of the image forming apparatus illustrated in FIG. 2.

The deducing process of Equation 1 will now be described in more detail. FIG. 7 illustrates an enlarged side view of a portion of the image forming apparatus illustrated in FIG. 2. As illustrated in FIG. 7, if a unit body of the light exposing unit 140 is deformed by heat, an emitted light of the light exposing unit 140 may proceed in a different direction from an intended first emitted light B1. Accordingly, the light exposing unit 140 may begin to emit light in a direction so as to expose positions L2 or L3 biased in the sub scanning direction Y with respect to the intended light exposure position L1.

Accordingly, for example, if the actual light exposure position of the light exposing unit 140 is determined to be biased in the forward direction of the sub scanning direction Y, such as that illustrated by position L3, the control unit 190 may control the light exposing unit 140 to start the exposing at a time in which the intended light exposure position L1 of the image carrying body 137 has rotated to reach the actual light exposure position L3. Accordingly, the bias can be offset.

In other words, the light exposing timing may be delayed by the correction time Δt from the original light exposing timing. As illustrated in FIG. 6B, the control unit 190 shifts the light exposing timing t1 of the light exposing signal E3 right by the correction time Δt. Accordingly, light exposing signals of times after the light exposing signal E3 can be shifted right by the correction time Δt.

Here, the correction of the light exposing signal may be applied to the next light exposing signal after the light exposing signal E3.

Conversely, if the actual light exposure position of the light exposing unit 140 is determined to be biased in the backward direction of the sub scanning direction Y, such as that illustrated by position L2, the control unit 190 may control the light exposing unit 140 to start the exposing at a time in which the intended light exposure position L1 of the image carrying body 137 reaches the actual light exposure position L2.

In other words, the control unit 190 may correct the light exposing signal so that the light exposing timing of the light exposing signal can start earlier by the correction time Δt.

With the above configuration, by correcting the biased amount ΔL in the sub scanning direction Y of the light emitted from the light exposing unit 140, the light exposing unit 140 can correctly expose the intended position on the image carrying body 137 to the emitted light. Accordingly, the light exposing precision of the light exposing unit 140 can be improved.

Also, although the light exposing unit 140 may be deformed by heat, the biased amount in the sub scanning direction of the emitted light of the light exposing unit 140 can be correctly detected.

Also, the detected biased amount can be corrected without engaging a separate cooling mode, thereby improving the printing speed.

Also, by correcting the light exposing signal based on the detected biased amount, the color registration error can be reduced, thereby embodying a clear color image quality.

The control unit 190 can correct a light exposing signal corresponding to a light exposing line to be printed as a first part of a printing medium based on the detected biased amount. In other words, the control unit 190 may determine to delay the correction of the light exposing signal until the start of a new page of the printing medium. This may be preferred to immediately correcting the light exposing line at a mid-point of the page of the printing medium, due to the fact that a rapid bias in comparison to the prior light exposing line may occur, and a user may regard the color registration as being further deteriorated with respect to the corresponding page if a light exposing signal corresponding to a light exposing line of a middle area of the page is corrected. Such a mid-page correction could result in a non-corrected portion of the page, a corrected portion of the page, and a possible distorted border between the corrected and non-corrected portions of the page.

As illustrated in FIG. 3, the image forming apparatus 1 may include the previously discussed memory 175 to store a sensing signal of the light sensor 150 corresponding to the intended light exposing signal L1 illustrated in FIGS. 4 and 7, and may further include an input unit 173 to receive a copying command from a user.

The memory 175 may include at least one of a read only memory (ROM) and a flash memory capable of reading and writing. The control unit 190 may compare a sensing signal measured by the light sensor 150 and the sensing signal stored in the memory 175 to determine whether a light emitted by the light exposing unit 140 is biased in the sub scanning direction Y.

A sensing signal of the light sensor 150 measured with a uniform time period may be stored in the memory 175 instead of the sensing signal of the light sensor 150 corresponding to the intended light exposing line L1 illustrated in FIGS. 4 and 7. Accordingly, the sensing signal of the light sensor 150 measured in the prior period and stored in the memory 175 may be compared with the sensing signal of the light sensor 150 measured in the present period to determine whether the emitted light is biased in the sub scanning direction Y. By comparing the sensing signal of the light sensor 150 measured in the present time and the sensing signal of the emitted light in the prior time in such a manner, the controller 190 may determine whether there is a bias of the emitted light in the present time, and may detect the amount of the bias.

As illustrated in FIG. 2, the image forming apparatus 100 may further include charging rollers 131 to charge a surface of the image carrying bodies 137, developing rollers 135 to develop an electrostatic latent image formed on the image carrying bodies 137 with a developer, and supplying rollers 133 to supply the developer toward the developing rollers 135. The charging rollers 131, the developing rollers 135 and the supplying rollers 133 may be respectively accommodated to the plurality of the developing cartridges 130.

Also, as illustrated in FIG. 2, the image forming apparatus 100 may further include transferring rollers 163 to transfer a visible image on the image carrying bodies 137 formed by the developing rollers 135 to a printing medium, a printing medium supplying unit 110 to supply the printing medium toward the image carrying bodies 137, and a transporting unit 120 to transport the printing medium between the image carrying bodies 137 and the transferring rollers 163.

The printing medium supplying unit 110 may include a knock up plate 113 on which the printing medium is loaded, and a pickup roller 115 to pick up the printing medium loaded on the knock up plate 113.

The transporting unit 120 may include transporting rollers 123 to transport the printing medium picked up by the pickup roller 115, a printing medium charging roller 121 to charge the printing medium transported by the transporting rollers 123 so as to be attached to a printing medium transporting belt 125, the printing medium transporting belt 125 transporting the printing medium to pass between the image carrying bodies 137 and the transferring rollers 163, and driving rollers 127 to drive the printing medium transporting belt 125.

Visible images of colors Y, M, C and K respectively formed on the image carrying bodies 137 of the plurality of developing cartridges 130 may be transferred in sequence to a printing medium transported by the printing medium transporting belt 125 so that a color visible image can be formed on the printing medium.

The image forming apparatus 100 may further include a fusing unit 160 to fuse the color visible image on the printing medium. The fusing unit 160 may fuse the color visible image on the printing medium with heat and pressure.

Figure 8:
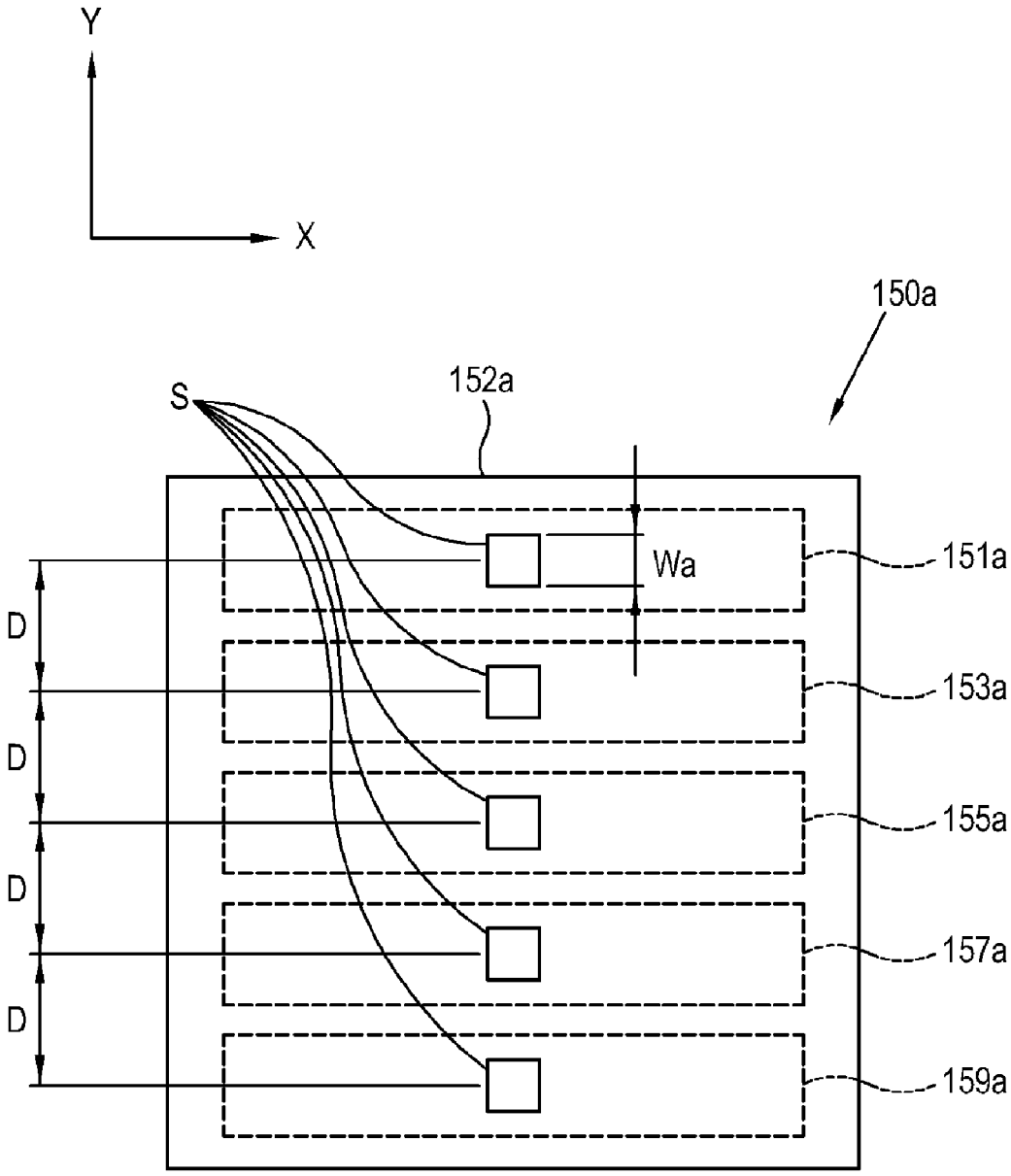
FIG. 8 illustrates an enlarged view of a light sensor of an image forming apparatus according to another exemplary embodiment of the present general inventive concept.

FIG. 8 illustrates an enlarged view of a light sensor of an image forming apparatus according to another exemplary embodiment of the present general inventive concept. An image forming apparatus according to this embodiment of the present invention may include a light sensor 150*a* and a mask 152*a* as illustrated in FIG. 8, rather than the light sensor 150 and mask 152 illustrated in FIGS. 4 and 5.

The image forming apparatus according to this embodiment may employ similar elements as those included in the image forming apparatus 100 illustrated in FIG. 2, with the exception of the light sensor 150*a* and the mask 152*a* which are provided in place of the light sensor 150 and mask 152 illustrated in FIGS. 4 and 5.

As illustrated in FIG. 8, the mask 152*a* may include a plurality of slits S formed in a line in the sub scanning direction Y. The plurality of slits S may be provided so that a distance D in the sub scanning direction Y between centers thereof can be uniform.

Here, the width Wa in the sub scanning direction of the plurality of slits S may be smaller than ½ of the distance D.

The light sensor 150*a* may include a plurality of light receiving sensors 151*a*, 153*a*, 155*a*, 157*a* and 159*a* to receive light emitted from the light exposing unit 140. The plurality of light receiving sensors 151*a*, 153*a*, 155*a*, 157*a* and 159*a* may be disposed in the sub scanning direction Y.

Figure 9:
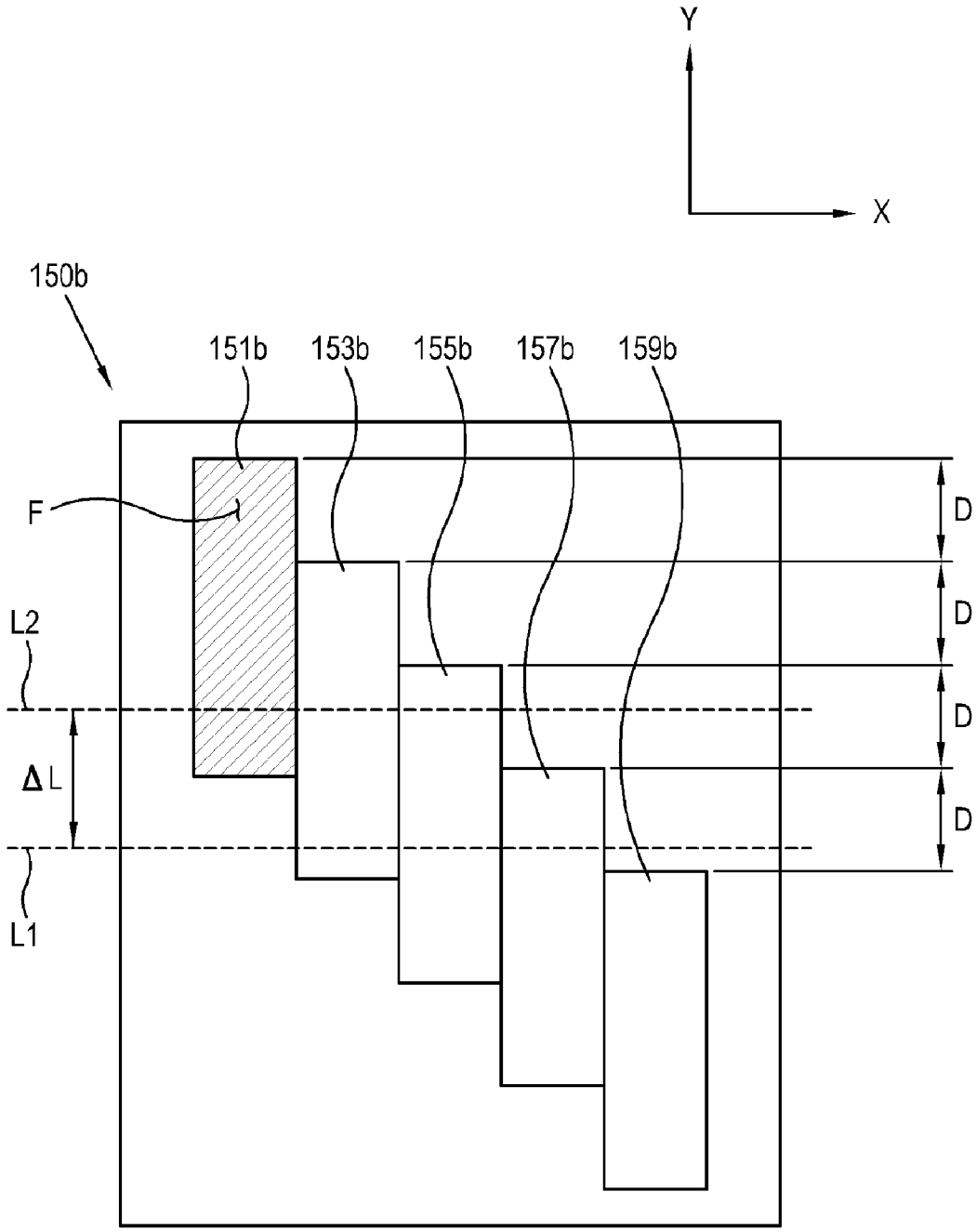
FIG. 9 illustrates an enlarged view of a light sensor of an image forming apparatus according to yet another exemplary embodiment of the present general inventive concept.

FIG. 9 illustrates an enlarged view of a light sensor of an image forming apparatus according to yet another exemplary embodiment of the present general inventive concept. An image forming apparatus according to this embodiment includes a light sensor 150*b* illustrated in FIG. 9, rather than the light sensor 150 illustrated in FIGS. 4 and 5.

The image forming apparatus according to the this embodiment may employ similar elements as those included in the image forming apparatus 100 illustrated in FIG. 2, with the exception of the light sensor 150*b* which is provided in place of the light sensor 150 and mask 152 illustrated in FIGS. 4 and 5.

The light sensor 150*b* according to this embodiment may detect a bias amount ΔL of an emitted light of the light exposing unit 140 without a mask, as opposed to the mask and light sensor combinations described in the previously discussed embodiments of the present general inventive concept.

The light sensor 150*b* may include a plurality of light receiving elements 151*b*, 153*b*, 155*b*, 157*b* and 159*b* biased in the sub scanning direction Y.

The light sensor 150*b* may be a single sensor manufactured by a semiconductor manufacturing process.

The light receiving element 151*b* may include a light receiving area F capable of receiving light, such as the shaded section illustrated in FIG. 9, and the other light receiving elements 153*b*, 155*b*, 157*b* and 159*b* may include the same.

The plurality of light receiving elements 151*b*, 153*b*, 155*b*, 157*b* and 159*b* may be provided so that the light receiving area F of the vicinal light receiving elements 151*b*, 153*b*, 155*b*, 157*b* and 159*b* can cross one another in the main scanning direction X. That is, the plurality of light receiving elements 151*b*, 153*b*, 155*b*, 157*b* and 159*b* may be provided so as to be biased by a uniform interval D in order in the sub scanning direction Y along the main scanning direction X.

If an emitted light corresponding to the intended light exposing line L1 is emitted from the light exposing unit 140, light may be sensed to exist in a part of the plurality of light receiving elements 151*b*, 153*b*, 155*b*, 157*b* and 159*b*. The sensing result may be stored in the memory 175 to determine whether the emitted light of the light exposing unit 140 is biased in the sub scanning direction Y.

As illustrated in FIG. 9, the intended light exposing line L1 should be emitted onto the light receiving elements 153*b*, 155*b*, and 157*b*. In other words, if the light exposing unit 140 is emitting light so as to be exposed onto the proper light exposing line L1, the light will not be sensed by the light receiving elements 151*b* and 159*b*.

If the emitted light emitted by the light exposing unit 140 is sensed in light receiving elements other than the light receiving elements 153*b*, 155*b* and 157*b* corresponding to the intended light exposing line L1, which may also result in the emitted light not being received by one or more of the light receiving elements 153*b*, 155*b*, and 157*b*, the emitted light may be determined to be biased in the sub scanning direction Y. For example, a light exposing line L2 biased in the sub scanning direction Y, as illustrated in FIG. 9, may be formed on the surface of the image carrying body 137. Also, the biased amount ΔL may be detected as the illustrated uniform interval D having a positive value.

As described above, the uniform interval D may be a distance corresponding to a dot pitch of a specific resolution. If the specific resolution is 600 dpi, the uniform interval D may be 42 μm. Accordingly, in the resolution of 600 dpi, the biased amount in the sub scanning direction Y of the emitted light by a single dot unit can be detected.

If the detecting unit capable of detecting is configured so as to detect a biased amount in the sub scanning direction Y by 3 dots instead of the single dot, the uniform interval D may be 126 μm (=42 μm×3).

As an alternative configuration, the interval D biased in the sub scanning direction Y between the plurality of light receiving elements 151*b*, 153*b*, 155*b*, 157*b* and 159*b* may be not uniform.

Also, while the number of the plurality of light receiving elements 151*b*, 153*b*, 155*b*, 157*b* and 159*b* is exemplarily illustrated as five, it is understood that a higher or lower number of light receiving elements may be provided according to desired efficiency, sensitivity, etc.

Figure 10:
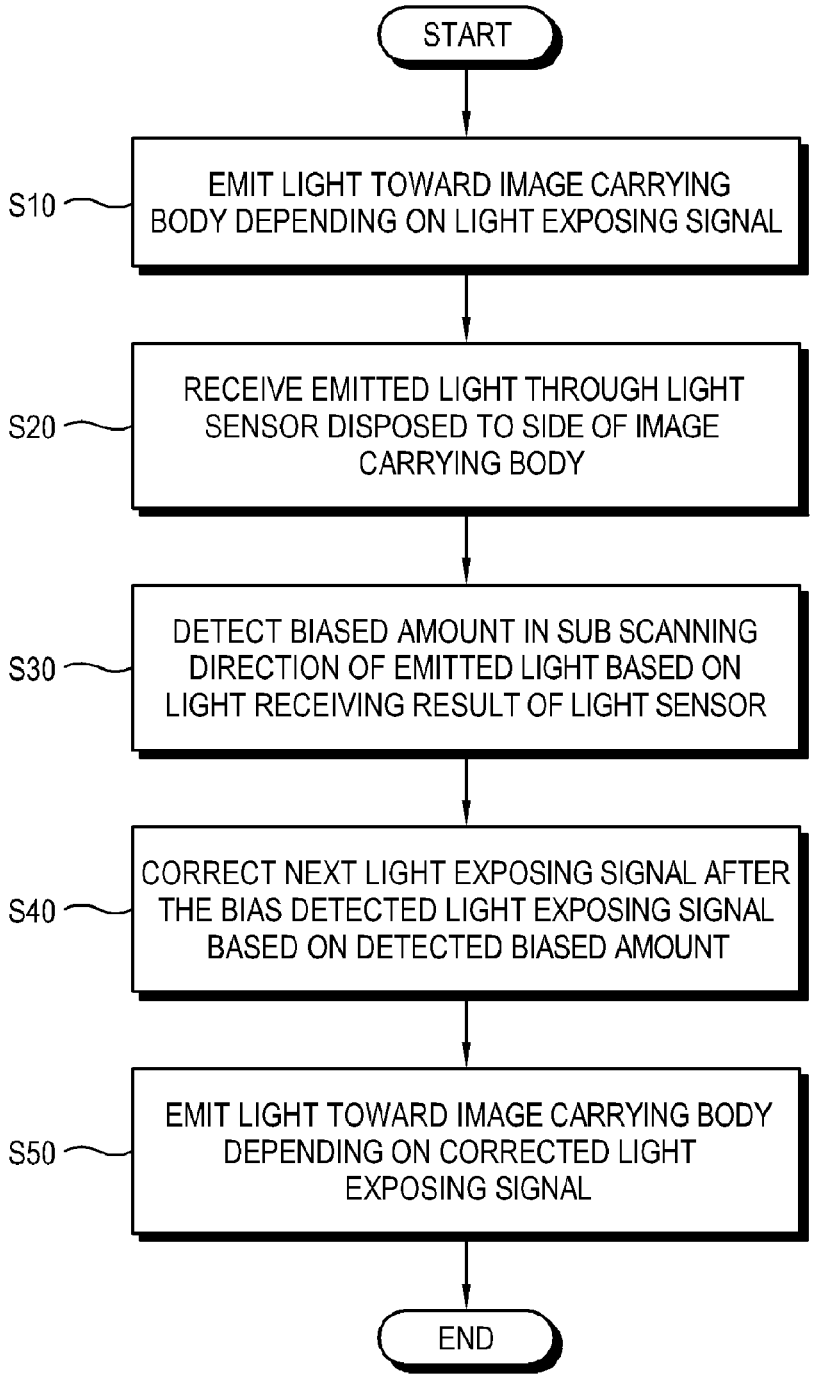
FIG. 10 is a flowchart illustrating a control method of an image forming apparatus according to an exemplary embodiment of the present general inventive concept.

FIG. 10 is a flowchart illustrating a control method of an image forming apparatus according to an exemplary embodiment of the present general inventive concept. This control method will be described by referring to the image forming apparatus 100 illustrated in FIG. 2.

At operation S10, a light is emitted toward the image carrying body 137 depending on a light exposing signal. The light exposing signal may be generated under the assumption that the light exposing unit 140 correctly exposes a predetermined intended (normal or proper) light exposing line L1 without being deformed. The light exposing signal may be generated based on image data received from a host apparatus (not shown) such as an external computer connected to the image forming apparatus 100. Alternatively, if the image forming apparatus 100 includes a scanning unit (not shown) scanning an image of a document, the light exposing signal may be generated based on an image data scanned by the scanning unit. These are merely two examples of how the image data may be received by the image forming apparatus 100, it is understood that the present general inventive concept is not limited thereto.

Also, the light exposing signal may include binary data configured to have values of '1' and '0', wherein '1' means exposing, and '0' means non exposing. In other words, if the light exposing signal is '1', a light source (not shown) of the light exposing unit 140 is turned on, and conversely, if the light exposing signal is '0', the light source is turned off. Alternatively, the data values of '1' and '0' may indicate the opposite actions, with the light exposing signal '1' turning the light off, and the light exposing signal '0' turning the light on.

The light exposing unit 140 may emit a light toward the image carrying body 137 according to the light exposing signal (referring to E1 and E2 in FIGS. 6A and 6B) configured by combination of '1' and '0'.

In operation S20, the emitted light is received by the light sensor 150 disposed to a side of the image carrying body 137.

In operation S30, a biased amount in the sub scanning direction Y of the emitted light is detected based on a light receiving result of the light sensor 150.

In the biased amount detection of operation S30, the light receiving result of the light sensor 150 and a light receiving result previously stored in the memory 175 may be compared to detect a bias of the emitted light and the biased amount thereof.

The detecting of the biased amount may be performed by each light exposing signal. Alternatively, the detecting may be performed with a predetermined time interval, or may be performed by each printing job. Also, the biased amount may be detected by each page ending light exposing signal forming the last line of a page of a printing medium. For example, based on a biased amount measured with respect to a light emitted based on a page ending light exposing signal of a first page, a page starting light exposing signal of the next second page may be corrected.

In operation S40, the next light exposing signal after the light exposing signal in which the bias was detected is corrected based on the detected biased amount. As described above, this may be corrected by shifting a light exposing starting timing of the next light exposing signal.

In operation S5*b*, a light is emitted toward the image carrying body 137 depending on the corrected light exposing signal.

In the method illustrated in FIG. 10, the next light exposing signal after the light exposing signal with a detected bias amount is described as being corrected without determining whether the next light exposing signal is a page starting light exposing signal formed first with respect to a page of a printing medium to be printed or not.

Figure 11:
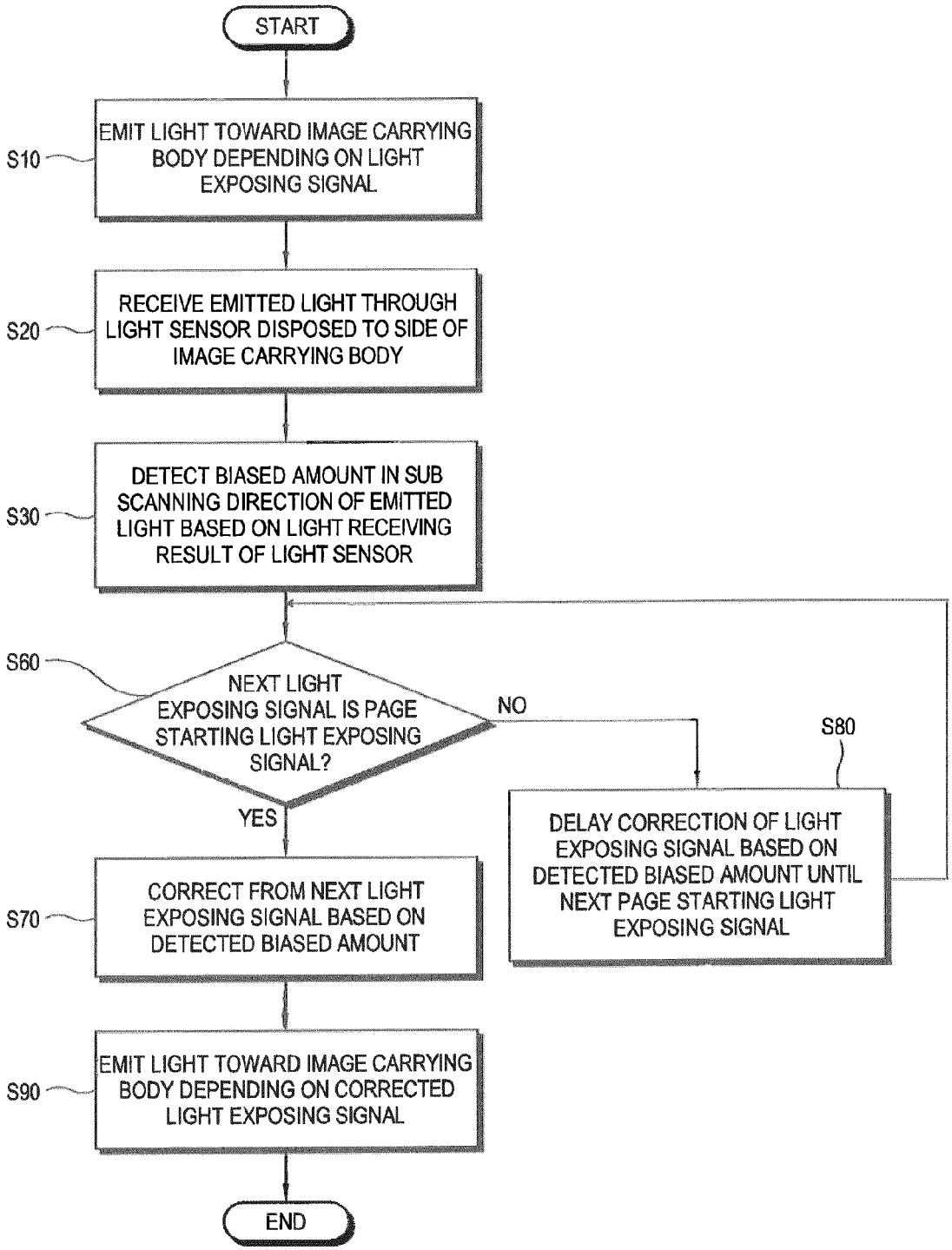
FIG. 11 is a flowchart illustrating a control method of an image forming apparatus according to another exemplary embodiment of the present general inventive concept.

FIG. 11 is a flowchart illustrating a control method of an image forming apparatus according to another exemplary embodiment of the present general inventive concept. As illustrated in 11, and again referring to FIG. 2, in this embodiment of control method of the image forming apparatus 100, the operations S40 and S50 illustrated in FIG. 10 may be replaced by operations S60 to S90.

Operations S10 through S30 are performed as described in the discussion of FIG. 10. However, in operation S60, it is determined whether the next light exposing signal after the light exposing signal in which a bias amount has been detected is a page starting light exposing signal. In other words, it is determined whether the next light exposing signal will form a first line of a page of a printing medium.

If the next light exposing signal is the page starting light exposing signal (YES in operation S60), in operation S70 the next light exposing signal and light exposing signals thereafter are corrected based on the detected biased amount.

If the next light exposing signal is not the page starting light exposing signal (NO in S60), in operation S80 the light exposing signals are not corrected until the occurrence of the next page starting light exposing signal, at which point the page starting light exposing signal and light exposing signals after the page starting light exposing signal are corrected based on the detected biased amount.

In operation S90, a light is emitted toward the image carrying body 137 depending on the corrected light exposing signal.

By determining whether the next light exposing signal is the page starting light exposing signal, a rapid color registration change before and after correction can be prevented. That is, if the next light exposing signal is to be expose upon a middle part of a page of a printing medium to be printed, and if the next light exposing signal is immediately corrected, a black line in the main scanning direction X around an image part corresponding to the next light exposing signal may be caused due to a biased amount difference from the prior light exposing signal. The embodiment illustrated in FIG. 11 can prevent the black line from being caused.

As described above, an image forming apparatus according to the present general inventive concept may produce at least the following benefits.

First, a light exposing precision of a light exposing unit can be improved.

Second, a uniform position on a surface of an image carrying body can be exposed even if a supporting configuration of a light exposing unit is deformed by heat.

Third, a light exposure position error due to deformation by heat of a light exposing unit can be detected with a low cost, thereby reducing a product manufacturing cost.

Fourth, it is unnecessary to perform a separate cooling mode to cool an overheated light exposing unit, thereby improving a printing speed.

Fifth, a color registration can be improved, thereby improving the quality of a color image.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, DVDs, magnetic tapes, floppy disks, and optical data storage devices. The computer-readable recording medium can also be distributed over network coupled computer systems so that the computer-readable code is stored and executed in a distributed fashion. The computer-readable transmission medium can be transmitted through carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although various exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising;

at least one image carrying body having a surface extending in a main scanning direction;

a light exposing unit that emits a light toward the image carrying body in a light axis direction that is perpendicular to the main scanning direction according to a light exposing signal;

a light sensor that is disposed to a side of the image carrying body to receive a part of the emitted light traveling in the light axis direction;

a mask that is formed with a plurality of slits; and a control unit that detects a biased amount in a sub scanning direction of the emitted light of the light exposing unit based on a sensing result of the light sensor, the sub scanning direction being perpendicular to each of the main scanning direction and the light axis direction, wherein the light sensor comprises a plurality of light receiving elements arranged one next to the other along the main scanning direction, each of the light receiving elements receiving a respective light passing through a respective slit, and the plurality of light receiving elements comprise a plurality of photo sensors that respectively detect existence of the respective light.

2. The image forming apparatus according to claim 1, wherein the control unit corrects the light exposing signal based on the detected biased amount, and controls the light exposing unit to emit a light toward the image carrying body according to the corrected light exposing signal.

3. The image forming apparatus according to claim 1, wherein the plurality of slits are biased in the sub scanning direction.

4. The image forming apparatus according to claim 3, wherein the plurality of slits are biased in order by a predetermined interval in the sub scanning direction.

5. The image forming apparatus according to claim 1, wherein the plurality of slits are disposed in a plurality of lines in the sub scanning direction.

6. The image forming apparatus according to claim 5, wherein the plurality of slits are provided to have a uniform interval between central parts of vicinal slits.

7. The image forming apparatus according to claim 6, wherein the uniform interval corresponds to an interval between dots in a predetermined resolution.

8. The image forming apparatus according to claim 1, wherein the image carrying body comprises a plurality of image carrying bodies, and the light sensor is disposed to a side of at least one of the plurality of image carrying bodies.

9. A method of controlling an image forming apparatus having an image carrying body have a surface extending in a main scanning direction, the method comprising:

emitting a light toward the image carrying body in a light axis direction that is perpendicular to the main scanning direction according to a light exposing signal;

receiving the emitted light traveling in the light axis direction at a light sensor disposed to a side of the image carrying body; and detecting a biased amount in a sub scanning direction of the emitted light based on a light receiving result of the light sensor, the sub scanning direction being perpendicular to each of the main scanning direction and the light axis direction, wherein the light sensor comprises a plurality of light receiving elements arranged one next to the other along the main scanning direction that respectively receive a light passing through a plurality of slits which is formed in a mask allowing the light to be received by a respective receiving element and the plurality of light receiving elements comprise a plurality of photo sensors that respectively detect existence of the light.

10. The control method of the image forming apparatus according to claim 9, further comprising:

correcting a subsequent light exposing signal based on the detected biased amount, and emitting a light toward the image carrying body depending on the corrected light exposing signal.

11. The control method of the image forming apparatus according to claim 10, wherein the correcting the subsequent light exposing signal comprises:

correcting the subsequent light exposing signal based on the detected biased amount in response to the subsequent light exposing signal being a page starting light exposing signal to be formed first on a page of a printing medium.

12. The control method of the image forming apparatus according to claim 10, wherein the correcting the subsequent light exposing signal comprises:

delaying the correcting of the subsequent light exposing signal until the subsequent light exposing signal is a page starting light exposing signal, and then correcting the subsequent light exposing signal and following light exposing signals based on the detected biased amount.

13. An image forming apparatus comprising:

an image carrying body including a surface extending in a main scanning direction to receive emitted light;

a mask that is formed with a plurality of slits; and a light sensor provided adjacent to the image carrying body to receive a portion of light that is emitted along a light axis direction by a light exposing unit and to detect a bias in a sub scanning direction of the emitted light, the sub scanning direction being perpendicular to each of the main scanning direction and the light axis direction, wherein the light sensor comprises a plurality of light receiving elements arranged one next to the other along the main scanning direction, each of the light receiving elements receiving a respective light passing through a respective slit, and the plurality of light receiving elements comprise a plurality of photo sensors that respectively detect existence of the respective light.

14. The image forming apparatus of claim 13, further comprising:

a controller to determine an amount of the bias according to results of the light sensor.

15. The image forming apparatus of claim 14, wherein the controller corrects a light exposing signal which controls the emitted light to eliminate the bias.

16. The image forming apparatus of claim 13, wherein the plurality of light receiving elements are provided in the scanning direction, and the slits are biased in the sub scanning direction.

17. The image forming apparatus of claim 16, wherein the slits are provided at offset intervals such that the amount of bias may be determined by the one or more light receiving elements receiving the emitted light.

18. The image forming apparatus of claim 13, wherein the plurality of light receiving elements are provided in the scanning direction; and the plurality of slits correspond to the respective light receiving elements.

19. The image forming apparatus of claim 18, wherein the slits are provided with predetermined dimensions and at offset intervals such that the amount of bias may be determined by the one or more light receiving elements receiving the emitted light through the slits.

* * * * *